US009074811B2

(12) United States Patent
Korkmaz

(10) Patent No.: US 9,074,811 B2
(45) Date of Patent: Jul. 7, 2015

(54) REFRIGERATOR

(75) Inventor: Erdem Korkmaz, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 369 days.

(21) Appl. No.: 12/302,883

(22) PCT Filed: May 29, 2007

(86) PCT No.: PCT/EP2007/055213

§ 371 (c)(1), (2), (4) Date: Nov. 29, 2008

(87) PCT Pub. No.: WO2007/138065

PCT Pub. Date: Dec. 6, 2007

(65) Prior Publication Data

US 2009/0113925 A1 May 7, 2009

(30) Foreign Application Priority Data

May 31, 2006 (TR) ..... a 2006 02734

(51) Int. Cl.
*F25D 23/06* (2006.01)

(52) U.S. Cl.
CPC ..... *F25D 23/066* (2013.01); *F25D 2201/126* (2013.01)

(58) Field of Classification Search
CPC ..... F25D 23/066; F25D 23/062; F25D 23/06; F25D 2201/14; F25D 2201/126; Y02B 40/34
USPC ..... 312/401, 406; 428/519, 521; 52/309.9, 52/784.15
See application file for complete search history.

(56) References Cited

U.S. PATENT DOCUMENTS

| | | | | | |
|---|---|---|---|---|---|
| 4,005,919 | A * | 2/1977 | Hoge et al. | ..... | 312/406 |
| 5,219,665 | A * | 6/1993 | Chen et al. | ..... | 428/515 |
| 5,221,136 | A | 6/1993 | Hauck et al. | | |
| 5,340,208 | A | 8/1994 | Hauck et al. | | |
| 5,460,868 | A | 10/1995 | Yamato et al. | | |
| 5,622,059 | A * | 4/1997 | McClellan | ..... | 62/448 |
| 5,730,516 | A * | 3/1998 | Vismara | ..... | 312/406 |
| 5,834,126 | A | 11/1998 | Sheu | | |
| 6,164,739 | A * | 12/2000 | Schulz et al. | ..... | 312/406 |
| 6,589,646 | B1 * | 7/2003 | Morgenstern | ..... | 428/318.6 |
| 2003/0041612 | A1 * | 3/2003 | Piloni et al. | ..... | 62/277 |

FOREIGN PATENT DOCUMENTS

| | | | | | |
|---|---|---|---|---|---|
| DE | 19712140 | A1 * | 9/1998 | ..... | F25D 23/06 |
| DE | 19908616 | A1 * | 1/2006 | ..... | B32B 27/08 |
| EP | 0531931 | A | 3/1993 | | |
| EP | 0533388 | A | 3/1993 | | |
| GB | 2415766 | A * | 1/2006 | ..... | F25D 17/04 |
| WO | 96/20977 | A | 7/1996 | | |

* cited by examiner

*Primary Examiner* — Patrick Hawn
(74) *Attorney, Agent, or Firm* — Venjuris, P.C.

(57) ABSTRACT

The present invention relates to a refrigerator (1) wherein plastic liner sheets (6) are used in manufacturing the inner casings (2) of the body and/or the doors, the liner sheet (6) forming the inner casing (2) comprising a main layer (7) produced of HIPS (high impact polystyrene) material by extrusion process, and a protective layer (8) which is formed on the (inner) surface of the main layer (7) facing the compartment (4) by co-extrusion method, having a high chemical resistance and a gloss that is not decreased below a certain limit.

7 Claims, 2 Drawing Sheets

REFRIGERATOR

Figure 1:
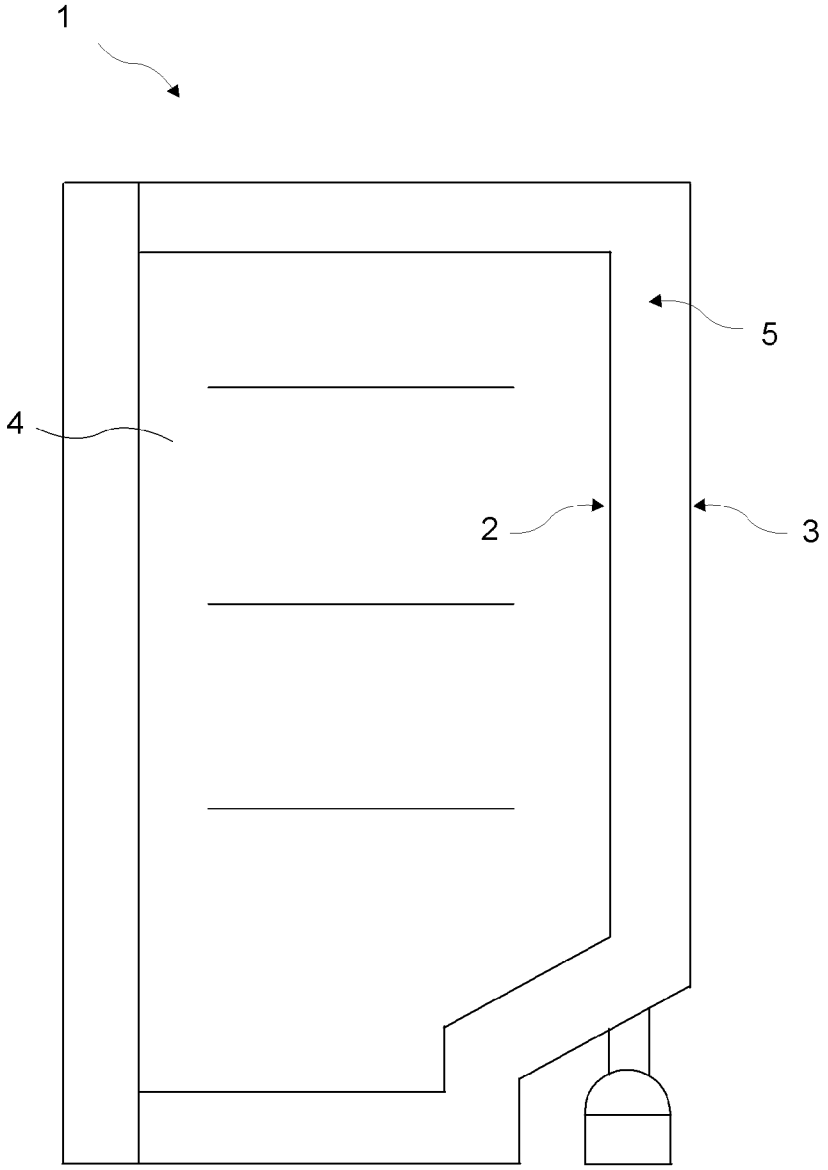

The present invention relates to a refrigerator wherein plastic liner sheets are utilized in the production of the body inner casings.

In the production of the inner casings of the body or the doors of refrigerators, liner sheets of plastic material are used, e.g. polystyrene (HIPS—High Impact Polystyrene) manufactured by extrusion method and these sheets are formed into their final shapes by thermoforming process. In refrigerators, the smearing of substances having acidic properties such as cooking oils and oil vapors on the body and the inner casing of the doors during usage and the residuals of cleaning agents used in cleaning the inner casings have abrasive effects and result in cracking by breaking the polymer bonds. Since the plastic material used for producing the inner casings will also be acted on by thermal stresses during the operation of the refrigerator, material fatigue will develop and when combined together with the effect of chemical abrasives, the crack formation process is accelerated.

Formation of cracks is a common problem that occurs in plastic materials used in various fields of application resulting from interaction with the environment, additives with high viscosity, lubricating properties or rubber etc. are used in order to increase the (ESCR) environmental stress crack resistance of plastic materials.

In state of the art applications, polyurethane is injected between the liner sheet forming the inner casing of the body and the outer casing of the body. Since the hydrocarbon (CFC) gases used during the injection of polyurethane have abrasive effects, the surfaces of the plastic inner casings of the body in contact with the polyurethane material are covered with protective material layers to increase chemical resistance against the abrasive effects. The surfaces of the plastic inner casings of the body on the side wherein foodstuff is stored, are covered by materials with an antimicrobial finish or materials with a glossy finish for esthetic appearance and ease of cleaning; however, the cracking problem that occurs on the inner surfaces in the process of time cannot be prevented.

In the United States of America patent document U.S. Pat. No. 5,118,174, in a refrigerator, on the rear surface of the liner sheet forming the inner casing of the body wherein the insulation is foamed-in-place, a film is laminated of high elongation property that can withstand thermal stress variations and an additional outer layer to increase chemical resistance to diffusion of hydrocarbon gases used in injecting the insulation foam and forming a barrier between the liner sheet and the polyurethane insulation foam. Adhesive film layers are incorporated between the plastic liner sheet and these said layers.

In the Japanese patent document no. JP2103387, in a refrigerator body, a thin sheet of acrylonitrileon is extruded on the side wherein insulation material is injected and also on the inner side of the inner casing which is manufactured by vacuum molding and a cheaper core material of styrene resin is used between these thin sheet layers.

In the United States of America patent document no. US2005042247, a refrigerator inner body wall or at least one surface of the components in contact with the food and beverages has a surface layer formed of a chemical substance that is effective against the microbes and/or the fungi.

In the Great Britain patent document no. GB2294900, in a refrigerator, a multilayer inner casing configuration is described which is formed of ABS (acrylonitrile-butadiene-styrene) material containing variable amounts and thicknesses of the constituent elements.

The object of the present invention is the realization of a refrigerator comprising an inner casing male of plastic liner sheets, having a strong chemical resistance against substances such as oil and detergent.

The refrigerator realized in order to attain the aim of the present invention is explicated in the claims.

In the refrigerator of the present invention, the liner sheets forming the inner casings of the body and/or the door comprise a main layer produced of HIPS (High Impact Polystyrene) material by extrusion method and on the inner surface of the main layer facing the user, a protective layer is co-extruded, composed of fifty-fifty mixture and containing 50% by weight of glossy HIPS and PS-SE (Polystyrene-Polyethylene) compounds.

The protective layer forms a barrier on the inner surface of the inner casing wherein food items are stored against chemical abrasives such as oil, oil vapor and detergent residues and the problem of cracking is prevented. The protective layer by means of the glossy HIPS material of a certain proportion also provides the gloss on the inner surface of the inner casing not to decrease below a certain limit, providing an easy cleaning option and the esthetic appearance is enhanced since the surface roughness is within the desired limits.

Even though the PS-PE (Polystyrene-Polyethylene) material having a high chemical resistance but when used alone having a high surface roughness is utilized in the protective layer, the surface roughness coefficient does not increase in the mixture state and the surface roughness values obtained are as if entirely a glossy HIPS material with a low surface roughness is used.

In another embodiment of the present invention, a second protective layer is applied by co-extrusion process on the side of the main layer forming the liner sheet in contact with the polyurethane in the insulation volume. The PS-SE compound is used as the protective layer material and this layer does not need to have a glossy finish since it is on the side not viewed by the user, having only a high chemical resistance is sufficient.

The refrigerator realized in order to attain the aim of the present invention is illustrated in the attached claims, where:

FIG. 1—is the schematic view of a refrigerator.

Figure 2:
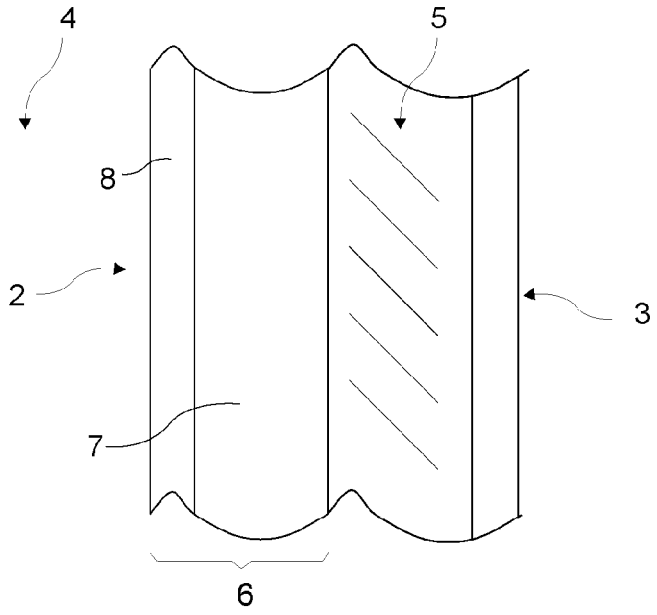

FIG. 2—is the schematic view of a plastic liner sheet having a protective layer on its surface facing the inner side of the refrigerator.

Figure 3:
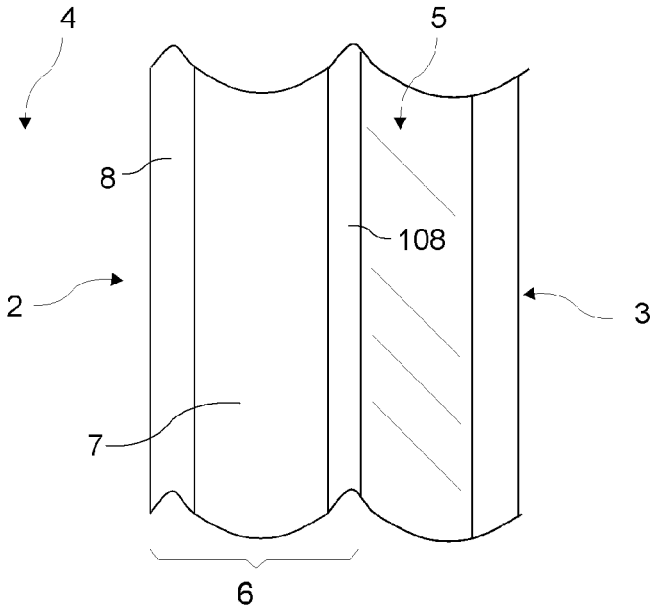

FIG. 3—is the schematic view of a plastic liner sheet having a protective layer both on its surface facing the inner side of the refrigerator and the side facing the insulation volume.

The elements illustrated in the figures are numbered as follows:

1. Refrigerator
2. Inner casing
3. Outer casing
4. Compartment
5. Insulation volume
6. Liner sheet
7. Main layer
8. , 108. Protective layer The refrigerator (1) comprises an inner casing (2) that forms the inner part of the body and/or the doors, an outer casing (3) forming the outer part of the body and/or the doors, a compartment (4) bounded peripherally by the inner casing (2) wherein the food and beverages are stored, and an insulation volume (5) situated between the inner casing (2) and the outer casing (3) wherein an insulation material such as polyurethane is injected.

A plastic liner sheet (6) is used in the production of the inner casing (2).

The liner sheet (6) is at first in the shape of a flat sheet, which is later given the final shape in the mould by thermoforming to produce the inner casing (2).

In the refrigerator (1) of the present invention, the liner sheet (6) which forms the inner casings (2) is comprised of a main layer (7) produced of HIPS (high impact polystyrene) material by the extrusion process, and a protective layer (8) male of a compound with approximately 50% in weight of glossy HIPS (high impact polystyrene) and approximately 50% in weight of PS-PE (Polystyrene-Polyethylene) which is applied on the (inner) surface of the main layer (7) facing the compartment (4) by co-extrusion method.

The protective layer (8) forms a barrier against chemical abrasives such as oil, oil vapor and detergent residues on the surface of the inner casing (2) on the side of the compartment (4) and thus cracking problem is avoided.

The protective layer (8), by means of the contained glossy HIPS material of a certain proportion, provides the gloss of the inner surface of the inner casing (2) facing the compartment (4) not to decrease below a certain limit. An easy cleaning convenience is provided and the esthetic appearance is enhanced since the surface roughness is within the desired limits besides the high chemical resistance of the protective layer (8).

In the embodiment of the present invention, for the protective layer (8) material when approximately 50% by weight of glossy HIPS (High Impact Polystyrene) is mixed with approximately 50% by weight of PS-PE (Polystyrene-Polyethylene) having high chemical resistance but a high surface roughness, the measured surface roughness value of this mixture does not increase, but has approximately the same surface roughness values as of 100% glossy HIPS material. In the surface roughness test, for both the glossy HIPS and for a mixture of 50% glossy HIPS-50% PS-PE, the surface roughness values less than 1 micron are found. While chemical resistance is increased by the protective layer (8), the desired gloss is not compromised on the inner surface of the inner casing (2) viewed by the user.

In the preferred embodiment of the present invention, the main layer (7) is produced of approximately 3.5 mm. and the protective layer (8) of approximately 90 micron thickness.

As the main layer (7) material, preferably low cost matte HIPS material is used. Matte HIPS is obtained by keeping low the master batch rate of HIPS material that provides color and gloss and cost advantage is provided by using matte HIPS.

In another embodiment of the present invention, a second protective layer (108) having a high chemical resistance is formed by co-extrusion process on the surface of the main layer (7) in contact with the insulation material in the insulation volume (5).

As the second protective layer (108) material, the compound of PS-PE (Polystyrene-Polyethylene) is used. Since the PS-PE (Polystyrene-Polyethylene) compound when used alone without mixing with another substance has a high surface roughness, it can be applied with convenience on the rear side of the main layer (7) not utilized by the user, providing only chemical resistance is deemed sufficient and cost advantage is maintained.

The protective layer (8) provides resistance against chemical abrasives such as cooking oils, oil vapors smeared during usage and residues of detergents used for cleaning on the inner surface of the inner casing (2) utilized by the user in refrigerators (1). With chemical resistance, the formation of cracks and the growing of cracks combining with thermal stresses are prevented and refrigerator (1) having a low cost, esthetically pleasing appearance and an easily cleanable inner casing (2) is provided.

The invention claimed is:

1. A refrigerator comprising an inner casing that forms the inner sides of the body and/or the doors, an outer casing forming the outer sides of the body and/or the doors, a compartment bounded peripherally by the inner casing wherein food and beverages are stored, and an insulation volume situated between the inner casing and the outer casing including an insulation material therein, and wherein the inner casing is manufactured of a plastic liner sheet having a main layer high impact polystyrene material having an inner surface, and a protective layer of a compound mixture with approximately 50% in weight of glossy high impact Polystyrene and approximately 50% in weight of Polystyrene-Polyethylene which is applied on the inner surface of the main layer facing the compartment.

2. The refrigerator as in claim 1, wherein the inner casing produced from the plastic liner sheet comprises a main layer of approximately 3.5 mm. and a protective layer of approximately 90 micron thickness.

3. The refrigerator as in claim 1 wherein the inner casing is produced from the plastic liner sheet and wherein a matte high impact Polystyrene material is used as the main layer material which does not contain enough glossy high impact Polystyrene to provide gloss or color.

4. The refrigerator as in claim 1, wherein the inner casing produced from the plastic liner sheet further comprises a second protective layer with a chemical resistance against chemical abrasives on a surface of the main layer which is then in contact with the insulation material in the insulation volume.

5. The refrigerator as in claim 4, wherein the second protective layer comprises Polystyrene-Polyethylene.

6. A refrigerator comprising an inner casing that forms the inner sides of the body and/or the doors, an outer casing forming the outer sides of the body and/or the doors, a compartment bounded peripherally by the inner casing wherein food and beverages are stored, and an insulation volume situated between the inner casing and the outer casing including an insulation material therein, and wherein the inner casing manufactured of a plastic liner sheet having a main layer comprising high impact polystyrene material and having an inner surface, and a protective layer of a compound mixture with approximately 50% in weight of glossy high impact Polystyrene and approximately 50% in weight of Polystyrene-Polyethylene applied on the inner surface of the main layer having the protective layer having a chemical resistance against chemical abrasives and a surface roughness approximately the same surface roughness value of 100% glossy high impact Polystyrene and providing chemical resistance against oils and detergents.

7. The refrigerator as in claim 6, wherein the protective layer has a surface roughness of less than 1 micron.

* * * * *